US010202720B2

(12) United States Patent
Cliver et al.

(10) Patent No.: US 10,202,720 B2
(45) Date of Patent: Feb. 12, 2019

(54) FLAME RESISTANT TEXTILE

(75) Inventors: James D. Cliver, Roebuck, SC (US); James Travis Greer, Chesnee, SC (US); Candace W. Sturcken, Taylors, SC (US); Samuel M. Caudell, Inman, SC (US); Shulong Li, Spartanburg, SC (US)

(73) Assignee: Milliken & Company, Spartanburg, SC (US)

( * ) Notice: Subject to any disclaimer, the term of this patent is extended or adjusted under 35 U.S.C. 154(b) by 326 days.

(21) Appl. No.: 12/776,816

(22) Filed: May 10, 2010

(65) Prior Publication Data

US 2011/0092119 A1 Apr. 21, 2011

Related U.S. Application Data

(60) Provisional application No. 61/274,133, filed on Oct. 21, 2009.

(51) Int. Cl.

| | |
|---|---|
| ***B32B 27/12*** | (2006.01) |
| ***D06M 13/422*** | (2006.01) |
| ***D06M 15/43*** | (2006.01) |
| ***D06M 15/431*** | (2006.01) |
| ***D06M 15/673*** | (2006.01) |
| ***D06M 15/70*** | (2006.01) |

(52) U.S. Cl.

CPC ..... *D06M 13/422* (2013.01); *D06M 15/43* (2013.01); *D06M 15/431* (2013.01); *D06M 15/673* (2013.01); *D06M 15/70* (2013.01); *D06M 2200/30* (2013.01); *Y10T 442/2689* (2015.04)

(58) Field of Classification Search

CPC .. D06M 13/422; D06M 15/43; D06M 15/431; D06M 15/673; D06M 15/70; D06M 2200/30; Y10T 442/2689

USPC ..... 442/136, 141–143, 153

See application file for complete search history.

(56) References Cited

U.S. PATENT DOCUMENTS

| | | | | |
|---|---|---|---|---|
| 3,900,664 A | | 8/1975 | Miller | |
| 4,035,542 A | | 7/1977 | Rosenthal et al. | |
| 4,078,101 A | | 3/1978 | Cole | |
| 4,092,108 A | | 5/1978 | Valko et al. | |
| 4,098,704 A | | 7/1978 | Sandler | |
| 4,123,574 A | * | 10/1978 | Wagner | 427/341 |
| 4,145,463 A | * | 3/1979 | Cole | 427/337 |
| 4,151,322 A | | 4/1979 | Rosenthal et al. | |
| 4,154,463 A | | 5/1979 | Wagner | |
| 4,178,399 A | | 12/1979 | Hall et al. | |
| 4,311,855 A | | 1/1982 | Colet et al. | |
| 4,419,401 A | | 12/1983 | Pearson | |
| 4,494,954 A | | 1/1985 | Cole et al. | |
| 4,513,042 A | | 4/1985 | Lumb | |
| 4,631,788 A | | 12/1986 | Dischler et al. | |
| 4,732,789 A | | 3/1988 | Hauser et al. | |
| 4,750,911 A | | 6/1988 | Hansen et al. | |
| 4,812,144 A | | 3/1989 | Hansen | |
| 4,837,902 A | | 6/1989 | Dischler | |
| 4,842,609 A | * | 6/1989 | Johnson | 8/115.7 |
| 4,868,041 A | | 9/1989 | Yamagishi et al. | |
| 4,909,805 A | | 3/1990 | Smith | |
| 4,918,795 A | | 4/1990 | Dischler | |
| 4,920,000 A | | 4/1990 | Green | |
| 4,990,368 A | | 2/1991 | Johnson et al. | |
| 5,033,143 A | | 7/1991 | Love, III | |
| 5,135,541 A | | 8/1992 | Cole et al. | |
| 5,223,224 A | | 6/1993 | Green | |
| 5,223,334 A | * | 6/1993 | Green | 442/214 |
| 5,238,464 A | | 8/1993 | Johnson et al. | |
| 5,356,700 A | | 10/1994 | Tanaka et al. | |
| 5,468,545 A | | 11/1995 | Fleming et al. | |
| 5,506,042 A | | 4/1996 | Ichibori et al. | |
| 5,579,207 A | | 11/1996 | Hayden et al. | |
| 5,822,835 A | | 10/1998 | Dischler | |
| 5,876,849 A | | 3/1999 | Green | |
| 5,928,971 A | | 7/1999 | Ellis et al. | |
| 6,358,608 B1 | | 3/2002 | Hanyon et al. | |
| 6,546,605 B1 | | 4/2003 | Emery et al. | |
| 6,626,964 B1 | | 9/2003 | Lunsford et al. | |

(Continued)

FOREIGN PATENT DOCUMENTS

| | | |
|---|---|---|
| CN | 101181677 A | 5/2008 |
| EP | 0 248 553 B1 | 1/1993 |

(Continued)

OTHER PUBLICATIONS

Lomakin et al., "Ecological Aspects of Polymer Flame Retardancy", 1999, VSP, p. 124.*

U.S. Appl. No. 11/503,006, filed Aug. 10, 2006, Sasser et al.

Database WPI, Week 200873 Thompson Scientific, London, GB; AN 2008-M34579, XP002632080, CN 101 181 677 A (Univ Beijing Sci&Eng), May 21, 2008 (May 21, 2008).

International Search Report and Written Opinion for PCT/US2010/049637.

Kirk-Othmer, Encyclopedia of Chemical Technology, p. 881, vol. 19, Fourth Edition (1996), John Wiley & Sons, Inc., USA.

Kirk-Othmer, Encyclopedia of Chemical Technology, pp. 213-215, vol. 3, Third Edition (1978), John Wiley & Sons, Inc., USA.

*Primary Examiner* — Vincent Tatesure

(74) *Attorney, Agent, or Firm* — Robert M. Lanning

(57) ABSTRACT

A flame resistant textile is provided. The textile is a sateen weave fabric containing cellulosic fibers, where the sateen weave fabric has a thickness of at least 19.5 mils, a thickness of at least 25 mils after 3 home washes at 120° F., an air permeability of at least 60 cfm, and a weight of less than about 7 oz/yd$^2$. The sateen weave fabric also contains a treatment, where the treatment contains a tetramethylhydroxy phosphonium salt or its condensate and chemical selected from the group consisting of urea, guanidines, guanyl urea, glycoluril, and polyamines. When the sateen weave fabric to which the treatment has been applied has been heat-cured and oxidized at least a portion of the cellulosic fibers have a pentavalent phosphate compound polymerized therein. The method for producing the flame resistant textile is also provided.

12 Claims, No Drawings

(56) References Cited

U.S. PATENT DOCUMENTS

| | | | | |
|---|---|---|---|---|
| 6,787,228 | B2 | 9/2004 | Campbell et al. | |
| 7,156,888 | B2 | 1/2007 | Mochizuki | |
| 7,182,991 | B1 | 2/2007 | Hirschmann, Jr. et al. | |
| 7,402,538 | B2 | 7/2008 | Bader et al. | |
| 2003/0157294 | A1* | 8/2003 | Green | 428/91 |
| 2003/0228812 | A1 | 12/2003 | Stanhope et al. | |
| 2004/0138083 | A1 | 7/2004 | Kimbrell, Jr. et al. | |
| 2005/0085145 | A1 | 4/2005 | Fang et al. | |
| 2006/0292953 | A1 | 12/2006 | Ashley et al. | |
| 2008/0038973 | A1* | 2/2008 | Sasser et al. | 442/181 |

FOREIGN PATENT DOCUMENTS

| | | | |
|---|---|---|---|
| EP | 0 704 570 | A1 | 4/1996 |
| GB | 761985 | * | 11/1956 |

* cited by examiner

FLAME RESISTANT TEXTILE

CROSS-REFERENCE TO RELATED PATENT APPLICATIONS

This application claims, pursuant to 35 U.S.C. § 119(e), priority to and the benefit of the filing date of U.S. Patent Application No. 61/274,133 filed on Oct. 21, 2009, the contents of which are hereby incorporated by reference.

TECHNICAL FIELD

Described herein are low weight flame resistant fabrics and the processes used to produce them.

BACKGROUND

Flame resistant (FR) textiles (for example clothing and blankets) are used by electrical workers and electricians to protect themselves from exposure to the thermal effects of an electric arc flash. The heat from an electric arc flash can be extremely intense and is accompanied by a shock wave due to the rapid heating of the air and gases in the vicinity of the arc flash.

Protective clothing systems called arc flash suits have been developed to protect workers who may be exposed to an arc flash. Suits are designed to provide protection for various levels of exposure. However, most garments available today are uncomfortable for wearing for long periods of time.

There is a need for a lighter weight textile for garments that increases user comfort while at the same time, still provides the required arc and flame protection.

BRIEF SUMMARY

A flame resistant textile is provided. In a first embodiment, the textile is a sateen weave fabric containing cellulosic fibers, where the sateen weave fabric has a thickness of at least 19.5 mils, a thickness of at least 25 mils after 3 home washes at 120° F., an air permeability of at least 60 cfm, and a weight of less than about 7 oz/yd$^2$. The sateen weave fabric also contains a treatment, where the treatment contains a tetrahydroxymethyl phosphonium salt or its condensate with a chemical or chemicals selected from the group consisting of urea, guanidines, guanyl urea, glycoluril, and polyamines. When the sateen weave fabric to which the treatment has been applied has been heat-cured and oxidized at least a portion of the cellulosic fibers have a pentavalent phosphate compound polymerized therein. The method for producing the flame resistant textile is also provided.

In a second embodiment, the flame resistant textile comprises a textile substrate. The textile substrate comprises cellulosic fibers. The flame resistant textile also comprises a finish applied to the textile substrate. The finish comprises a product of a chemical reaction between a tetramethylhydroxy phosphonium salt or its condensate and a chemical selected from the group consisting of urea, guanidines, guanyl urea, glycoluril, polyamines, and mixtures thereof. The mixture of the tetramethylhydroxy phosphonium salt or its condensate and the other chemical is applied to the textile substrate such that, when the textile substrate has been heat-cured and oxidized, the tetramethylhydroxy phosphonium salt or its condensate and the other chemical react to produce a pentavalent phosphate compound that is polymerized in the cellulosic fibers, and the pentavalent phosphate compound comprises amide linking groups. The flame resistant textile also comprises a hydrazide compound applied to the textile substrate. The hydrazide compound can be applied in any suitable amount, but preferably is applied at an amount not less than about 0.5% by weight of the fabric.

In another embodiment, the flame resistant textile comprises a textile substrate and a finish applied to the textile substrate. The textile substrate comprises cellulosic fibers. The finish comprises a phosphorous-containing compound. The phosphorous-containing compound comprises a plurality of pentavalent phosphine oxide groups having amide linking groups covalently bonded thereto, and at least a portion of the pentavalent phosphine oxide groups having three amide linking groups covalently bonded thereto. The flame resistant textile further comprises a hydrazide compound applied to the textile substrate.

DETAILED DESCRIPTION

The term "flame resistant" or "FR" is used to describe a material that burns slowly or that is self-extinguishing after removal of an external source of ignition. A fabric or yarn may be flame resistant because of the innate properties of the fiber, the twist level of the yarn, the fabric construction, or, as will be discussed herein, the presence of flame resistant chemicals durably applied to the fabric.

The term "flame retardant" or "flame retardant chemical" refers to a chemical compound that may be applied as a topical treatment to a fiber, fabric, or other textile item during processing to reduce its flammability. In the present case, flame retardant chemicals are applied to the already constructed fabric substrate to produce a flame resistant fabric.

In a first embodiment, the flame resistant textile contains a sateen weave fabric. The sateen weave fabric has a plurality of warp yarns running lengthwise in the machine direction and a plurality of fill yarns running substantially perpendicularly to the warp yarns (i.e., in the cross-machine direction). The sateen weave fabric is such that the face of the fabric consists almost completely of warp or filling floats produced in the repeat of the weave. The sateen structure is four over, one under, placing the most threads on the surface, making it extremely soft. An additional advantage to the sateen weave is that the fabric produced by the sateen weave is thicker than fabrics produced by other weaves, such as twill weaves or plain weaves, at the same weight.

The flame resistant fabric has a thickness of at least about 19.5 mils (approx. 0.5 mm) as received. "As received", in this application, means the fabric at the end of all processing conditions (including weaving, desizing/scouring, dyeing, FR treatment, finish application, mechanical treatment, etc.) and is the fabric in the finished roll or sewn goods. The flame resistant fabric has a thickness of at least about 25 mils (approx. 0.64 mm) after 3 standard home laundering cycles using water at 120° F. While not being bound to any theory, it is believe that the sateen weave, along with the processing steps applied to it, create a thicker fabric as compared to other types of weaves and therefore has higher arc protection for the wearer.

The flame resistant fabric has a weight of less than 7 oz/yd$^2$. In one embodiment, the flame resistant fabric has a weight of less than 6.5 oz/yd$^2$. While the same FR performance can be achieved with higher weight fabrics, the high weight fabrics have a tendency to be heavy, have poor air permeability, and therefore are uncomfortable to wear for extended periods of time. The flame resistant fabric has an air permeability of at least about 60 cfm, more preferably 100 cfm. These levels of air permeability have been shown to produce fabrics having good breath ability. Having high air permeability goes against the idea of some theories that high air permeability fabrics yield lower electrical arc ratings.

The sateen weave fabric comprises cellulosic fibers. The term "cellulosic" or "cellulosic fiber" generally refers to a fiber composed of, or derived from, cellulose, which is a chief component of the cell walls of plants. Examples of cellulosic fibers include cotton, rayon, linen, jute, hemp, and cellulose acetate, although the most common example is cotton and, as such, cotton will be the focus of the present disclosure. The cellulosic content of blended fabrics contributes significantly to its hand, drape, and breath ability, characteristics which provide comfort to wearers thereof. Moreover, traditional flame resistant processes have preferentially treated the cellulosic content of such blended fabrics, thereby imparting flame resistance to the target fabric.

In the United States, there are two varieties of cotton fibers that are commercially available: the American Upland variety (*Gossypium hirsutum*) and the American Pima variety (*Gossypium barbadense*). So-called "Egyptian" cotton is a variety of Pima cotton, which is often grown in Egypt. Generally, the American Upland fibers—which comprise the majority of the cotton used in the apparel industry—have lengths ranging from about 0.875 inches to about 1.3 inches, while the less common Pima cotton fibers have lengths ranging from about 1.2 inches to about 1.6 inches. Based on this length difference, Pima cotton is also known as "extra long staple" cotton.

Incorporation of Pima cotton into the fabric construction results in a fabric that is more durable and absorbent. Surprisingly, the flame resistant properties are enhanced with the inclusion of Pima cotton in place of, or used in conjunction with, American Upland cotton. These results are even more pronounced with repeated launderings. Preferably, the cotton fibers (regardless of species) have an average length of at least about 1.2 inches. In one embodiment, Pima cotton fibers are used in only the filling direction. Alternately, American Upland cotton may be used or other non-pima cottons may be used.

The sateen weave fabric may have essentially 100% cellulosic fibers, or may also include other synthetic fibers. In one embodiment, the fabrics have a synthetic fiber content of from about 0% to about 50% and a cellulosic fiber content of from about 50% to about 100%. In a second embodiment, the fabrics have a synthetic fiber content of from about 10% to about 65% and a cellulosic fiber content of from about 35% to about 90%. In yet another embodiment, the fabric may have a synthetic fiber content of from about 10% to about 50% and a cellulosic fiber content of from about 50% to about 90%.

While the term "synthetic" or "synthetic fiber" generally refers to all chemically produced fibers to distinguish them from natural fibers, and while this process is applicable to most, if not all, synthetic fiber types, the preferred fiber types used herein are thermoplastics. The percentages provided above are applicable to thermoplastic fibers, as well as the broader class of synthetic fibers.

"Thermoplastic" fibers are those that are permanently fusible and that may melt at higher temperatures. Examples of thermoplastic fibers used herein are polyesters (such as polyethylene terephthalate, polypropylene terephthalate, and polybutylene terephthalate), polyolefins (such as polyethylene and polypropylene), polyamides (such as nylon 6, nylon 6,6, nylon 4,6, and nylon 12), polyphenylenesulfide, and the like. Advantageously, the inclusion of such thermoplastic materials into the target fabrics, especially at higher fiber content levels, increases the mechanical properties (i.e., abrasion resistance, durability, etc.) of the treated fabrics. It should be understood that one or more thermoplastic fiber types may be incorporated in the desired content amount with one or more cellulosic fibers.

Further, non-thermoplastic synthetic fibers, such as carbon fibers, polyaramid fibers, polyacrylic fibers, aromatic polyamide, aromatic polyester, melamine formaldehyde polymer, polyimide, polysulfone, polyketone, polysulfone amide, and any combination thereof, may also be used in the blended fabrics. Preferably, the content (by weight of the fabric) of such fibers is less than about 50% (that is, the percentage of such non-thermoplastic fibers is between 0% and about 50%). These non-thermoplastic fibers may inherently be flame resistant and may contribute this and/or other desirable properties to the fabric. When present, the non-thermoplastic synthetic fibers are preferably present in an amount of from about 5% to about 50% based on the weight of the fabric; more preferably, in an amount from about 5% to about 15% based on the weight of the fabric. By way of example only, and without limitation, modacrylic fibers comprising vinyl chloride, vinyl bromide, or vinylidene chloride monomer units (either with or without antimony oxide) may be combined with cellulosic fibers to construct the fabric, in which case the modacrylic fiber content is from about 5% to about 50% by weight.

In one embodiment, the warp and/or fill yarns are preferably an intimate blend of synthetic and cellulosic fibers, and, in some instances, may be a 50/50 blend of cellulosic and synthetic fibers by weight. In other instances, an 80/20, an 88/12 or 75/25 blend of cellulosic and synthetic fibers (respectively) by weight may be used. The ratio may be modified as necessary to achieve the desired physical properties in the fabric. The warp yarns are preferably spun yarns. Blends of nylon and cotton fibers and blends of polyester and cotton fibers are well-suited for achieving the flame resistant characteristics sought herein, while imparting the functional attributes of durability, drape, breath ability, and the like. In another embodiment, the warp and/or fill yarns may be comprised of a single fiber type (for example, 100% cotton). The warp and/or filling yarns may also be spun by novel methods whereby the synthetic fibers essentially constitute the core or center of the yarn and the cellulosic fibers are wrapped or spun around the synthetic fibers so as to essentially constitute the outer surface of the yarn while maintaining blends in the desired ranges above. This forms "core-spun yarns".

It is to be understood that other warp constructions may also be used, including warps having alternating filament synthetic and cellulosic yarns (as described below) or having alternating intimate blended yarns and filament synthetic yarns, so long as the relative content of the cellulosic and synthetic components falls within the above-prescribed ranges. Particularly, the use of a small amount (by weight) of textured filament synthetic yarns in the fabric construction has been found to dramatically improve the fabric strength, while the cellulosic content ensures that the fabric will exhibit the desired flame resistant performance.

The fill yarns may be one of (i) a blend of synthetic and cellulosic fibers in the form of spun yarns, as provided in the warp direction, (ii) a pattern wise arrangement of filament synthetic and cellulosic yarns, and (iii) 100% cellulosic yarns. Exemplary blend ratios (by weight) of cellulosic to synthetic fibers include 90:10, 80:20, 75:25, and 50:50. Again, nylon and cotton yarns are preferred for many applications. In other applications, polyester and cotton yarns may be useful. Filament synthetic yarns (particularly textured filament yarns) are beneficial in providing desired strength and abrasion resistance in the finished fabric. Additionally, textured synthetic yarns provide stretch or elasticity to the fabric for improved fit, flexibility, and comfort.

The term "pattern wise arrangement" refers to a repeating pattern of synthetic and cellulosic yarns, found in the warp direction, the fill direction, or both. Representative patterns include 1:2 (one synthetic yarn followed by two cellulosic yarns) and 1:3 (one synthetic yarn followed by three cellulosic yarns). It should be understood that other patterns may also be used, provided the overall content of the cellulosic and synthetic yarns falls within the desired ranges.

In one potentially preferred embodiment, a cellulosic-containing woven fabric is provided, in which the warp yarns are an intimate blend of synthetic and cellulosic fibers and the fill yarns comprise a pattern wise arrangement of filament synthetic yarns and cellulosic yarns. In this instance, the ratio of synthetic yarns to cellulosic yarns in the fill direction is preferably one to at least three (that is, at least three cellulosic yarns are used for each synthetic yarn), although other patterns may be used to provide the same fiber content in the finished fabric. In yet another embodiment, a 1:2 ratio of synthetic yarns to cellulosic yarns is used.

Once the fabric is woven, it is prepared using conventional textile processes, such as desizing, bleaching, and scouring. If desired, the fabric may then be dyed and/or printed. The optionally dyed and/or printed fabric is then treated to obtain flame resistant characteristics, according to the process steps described herein.

In the other embodiments of the flame resistant textile, the textile substrate can be any suitable substrate, provided the textile substrate contains at least some cellulosic fibers. For example, in one embodiment, the textile substrate can have a synthetic fiber content of from about 0% to about 50% and a cellulosic fiber content of from about 50% to about 100%. In another embodiment, the textile substrate can have a synthetic fiber content of from about 10% to about 65% and a cellulosic fiber content of from about 35% to about 90%. In yet another embodiment, the textile substrate can have a synthetic fiber content of from about 10% to about 50% and a cellulosic fiber content of from about 50% to about 90%.

In these other embodiments of the flame resistant textile, the textile substrate can have any suitable construction and any suitable fabric weight. The textile substrate can have a woven, knit, or nonwoven construction, including any of those described above as being suitable for the first embodiment of the flame resistant textile. The textile substrate can also be constructed from any suitable yarns or combination of yarns, including any of those described above as being suitable for the first embodiment of the flame resistant textile. In certain embodiments, the fabric can have a weight ranging from about 4.0 ounce/yard$^2$ to about 16 ounce/yard$^2$, or from 5 ounce/yard$^2$ to 14 ounce/yard$^2$.

There are two main methods for treating the sateen weave fabric or textile substrate to make it flame resistant. A first method uses urea to react with the THP pre-condensate and a second method uses ammonia to react with the THP pre-condensate. The terms "urea based process" and "ammonia based process" will be used in the specification when referring to these two processes.

Both of the methods begin with a reaction product of tetra (hydroxymethyl) phosphonium ("THP") salt or its condensate with one of urea, guanidines, guanyl urea, glycoluril, and polyamines. In practice, a phosphorous-based component from the THP compound penetrates within the cellulosic fibers, thereby imparting durable flame resistant properties to the treated fabric.

The term "tetrahydroxymethylphosphonium salt" includes the salts of chloride, sulfate, acetate, carbonate, borate, and phosphate. It has been surprisingly found that the tetra (hydroxymethyl) phosphonium sulfate ("THPS") compound performs at least as well as the THP condensates previously used, when combined with one of urea, guanidines, guanyl urea, glycoluril, and polyamines. One example of such a THP salt is a tetra (hydroxymethyl) phosphonium sulfate (having about 77% solids and 11.5% active phosphorous) sold by Cytec Industries of West Paterson, N.J. under the trade name PYROSET® TKOW.

In one embodiment, a THP salt (e.g., a sulfate) is used as the flame retardant compound. The molar ratio of THP flame retardant to urea, in this instance, is from about 0.75:2 to about 0.75:4, about 0.85:1.8 to about 0.85:2.7, or about 0.85:2.1 to about 0.85:2.5. The THP salt concentration ranges from about 25% by weight to about 50% by weight or about 25% by weight to about 45% by weight of the formulation solution. Alternatively, a condensate of THP salt with urea (referred to as THP-urea condensate), instead of THP salt, may be used as the flame retardant compound. One example of such a THP condensate is sold under the trade name PYROSAN® C-FR (having about 70% solids and 10% active phosphorous) by Emerald Performance Materials of Charlotte, N.C. The ratio by weight of solid THP-urea condensate to urea can range from about 37:4 to about 37:15, about 37:6 to 37:12, or about 37:7 to 37:10.

Next the two methods diverge. In the urea based process, the THP salt or the THP pre-condensate is reacted on the fabric with urea to create an intermediate compound in which the phosphorous compound is present in its trivalent form. Such reaction is carried out in the fabric at sufficiently high temperatures to cause the THP (salt or condensate) to form covalent bonds with the cellulosic fibers, thus imparting greater durability of the flame retardant treatment to washing. The curing temperature is not so high that excessive reaction of the flame retardant with the cellulosic fibers occurs, which would otherwise lead to a weakening of the cellulosic fibers (and the fabric). Similarly, curing time must also be controlled carefully to prevent over-reaction of the THP with the cellulosic fibers. Depending on the curing oven used and the heat transfer efficiency, the curing temperature may range from about 132° C. (270° F.) to about 177° C. (350° F.), and the curing time may range from about 1 minute to about 5 minutes. More preferably, the curing temperature is in the range from about 149° C. (300° F.) to about 171° C. (340° F.), and the curing time is in the range from about 1 minute to about 3 minutes.

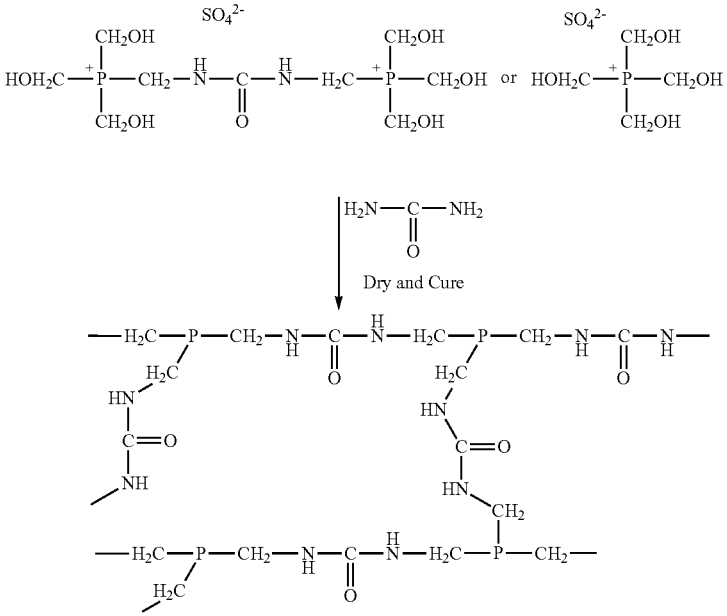

To fix the flame resistant compound to the fabric surface and to convert the trivalent phosphorous to its stable pentavalent form, the treated fabric is conveyed through a peroxide bath, in which the peroxide oxidizes the phosphorous compound. This step is illustrated below. The resultant pentavalent phosphate compound includes amide linking groups.

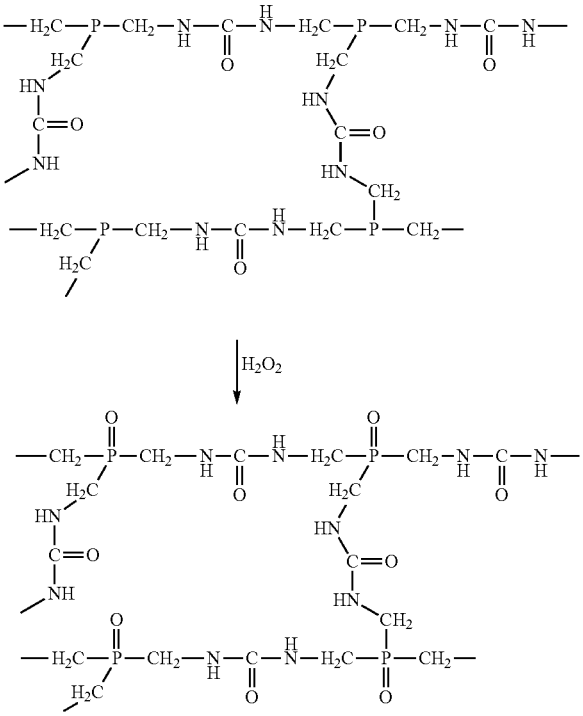

The optimum add-on level of the flame resistant chemical depends on the fabric weight and construction. Usually, for apparel applications where lighter weight fabrics are used, it is preferable to achieve an add-on level of 1.5%-3.5% phosphorous, based on the weight of the untreated fabric. Too little and, ironically, too much flame retardant seems to impair the fabric's ability to meet flammability or mechanical strength standards.

In one embodiment where the target fabric has a high synthetic content (i.e., from about 50% to about 65%), an aromatic halogenated compound is used in addition to the phosphorous-based flame resistant compound. Aromatic halogenated flame resistant chemistries possess excellent UV-light stability and excellent heat stability, even at the elevated temperatures associated with curing, as compared with aliphatic halogenated compounds. Preferably, the aromatic halogenated compounds have a melting temperature of equal to or less than about 40° C. (104° F.), making them liquids near room temperature.

The term "aromatic halogenated compound" refers to a compound having at least one halogen radical (e.g., bromine) covalently attached to an aromatic ring structure. Examples of aromatic brominated compounds include, for example, ethane-1,2-bis(pentabromophenyl); tetrabromophthalate esters; tetrabromobisphenyl A and its derivatives; and ethylenebromobistetrabromophthalimide. Other aromatic halogenated compounds, as are known in the art, may be used in place of the brominated compounds listed above.

In the ammonia based process, the pre-condensate (THP salt or the THP pre-condensate) is typically applied to the fabric and the fabric is subsequently dried at a temperature less than about 270° F. to reach a fabric moisture content between about 10% and 20% by weight. The precondesate may be formed by reacting THP or THP salt with a chemical selected from the group consisting of urea, guanidines, guanyl urea, glycoluril, and polyamines at a temperature between 45° C. and 120° C. The dried fabric is then placed in an atmosphere comprising ammonia gas (an enclosed chamber, for example, flushed with anhydrous ammonia gas), such that the ammonia gas reacts with the precondensate on the fabric, as shown in the following reaction scheme, to form an insoluble trivalent phosphorous product.

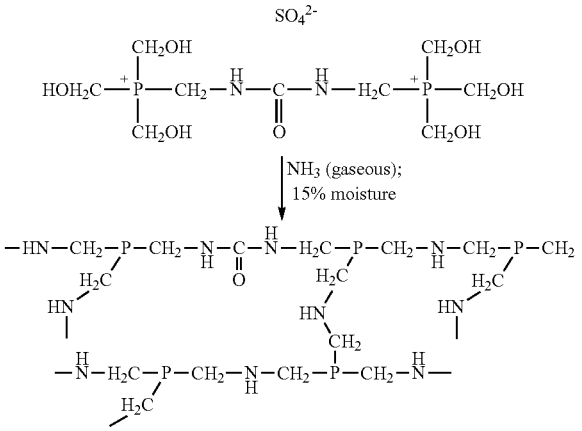

To fix the flame retardant compound to the fabric surface and to convert the trivalent phosphorous to its stable pentavalent form, the treated fabric is conveyed through a peroxide bath, in which the peroxide oxidizes the phosphorous compound. This step is illustrated below. The resultant pentavalent phosphate compound includes amine linking groups.

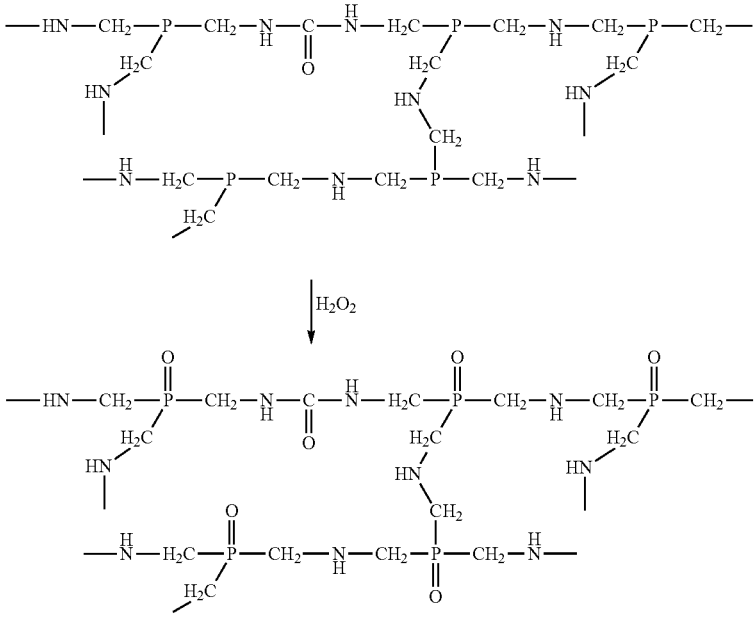

Ammoniated cellulosic fabrics have relatively good flame resistance, particularly in those instances in which cellulosic fibers comprise the majority of the fiber content. Another advantage of such ammonia-treated fabrics is that they tend to exhibit a soft hand and good tear strength.

The process for imparting flame resistance to a textile substrate involves the application of the selected flame retardant chemical(s) to the target textile fabric. An objective of this step of the process is to impregnate the fabric with the treatment chemistry (and optional additives, as will be discussed below), which is accomplished by saturating the fabric with the solution to allow thorough penetration into the fabric. Preferably, this is accomplished by padding—that is, passing the target fabric through an aqueous bath containing a solution of the flame retardant agent and any other desired additives (such as a wetting agent and a buffer agent for pH control) and subsequently through nip rollers. Alternately, the fabric may be sprayed or coated, using any known coating techniques.

Padding may be done on any conventional equipment, but equipment having nip rolls is preferred to ensure good penetration of the bath chemistry into the fabric. Assuming a 60% wet pick-up rate, a typical pad bath created to achieve a 1.5%-3.5% phosphorous deposit would include roughly 25-50% by weight of a THP salt or a THP condensate, with small amounts of wetting agents, softeners, and buffers (e.g., sodium acetate). It has been found that, to increase the stability of the bath, the components are preferably combined in the following order: wetting agent and water, buffer, softener, and flame retardant(s). Stirring is used to effectuate proper combination.

When the formulation is prepared, a small amount of alkaline material may be added to adjust the pH to the range of about 5 to about 8 and, more preferably, to the range of about 5 to about 7. It has been found that, when the pH is too low, incomplete curing tends to result. Conversely, when the pH is too high, wash durability of the flame resistant finish is adversely affected. Alkaline metal hydroxides, sodium carbonate (soda ash), sodium acetate, and sodium phosphate, for example, may be used to adjust the pH of the formulation.

Preferably, a softening agent (also known as a "softener") is included in the flame resistant chemical bath to significantly improve the hand of the treated fabric. It has been found that the inclusion of a softener also improves the tear strength of the finished fabric. Clearly, the softening agent selected for this purpose should not have a deleterious effect on the flammability of the resultant fabric. For example, silicone and silicone-based softeners (such as polydimethylsiloxane, aminosiloxane, and quarternary silicone) provide excellent hand, but negatively affect the flammability of the fabric. Certain sulfonated oils have also been found to adversely affect flammability. Some softeners, including polyamines and certain quarternary amines, when present in significant amounts, are unsuitable for the present application, because of their instability during curing conditions.

Therefore, cationic softening agents—such as one or more of polyolefins, modified polyolefins, ethoxylated alcohols, ethoxylated ester oils, alkyl glycerides, fatty acid derivatives, fatty imidazolines, parafins, halogenated waxes, and halogenated esters—are used instead to impart softness to the treated fabric. A single softening agent or a combination of different softening agents may be used. Alkylamines and quaternary alkylamines may also be used in small amounts, if combined with another softening agent of the types listed above.

In one embodiment, aromatic halogenated compounds having a melting temperature less than about 40° C. (104° F.), such as those described above, may be used in addition to, or in place of, the previously mentioned softening agents. Such aromatic halogenated compounds provide the dual benefit of imparting flame resistance and softness.

In addition to softening agents, other textile finishing compounds may be added to the bath solution, including, but not limited to, wetting agents, surfactants, stain release agents, soil repel agents, antimicrobial compounds, wicking agents, anti-static agents, antimicrobials, antifungals, and the like. Advantageously, chemicals that require, or benefit from, heat-setting or curing at high temperatures may be successfully incorporated into the flame retardant bath chemistry. As yet another alternative, as will be described further herein, soil repellent chemistry may be applied after the application of the flame retardant chemistry.

One potentially preferred combination of chemistries for imparting wash durable stain resistance and stain release is described in US Patent Application Publication No. 2004/0138083 to Kimbrell et al., the contents of which are hereby incorporated by reference. Briefly, the compositions useful for rendering a substrate with durable stain resistance and stain release are typically comprised of a hydrophilic stain release agent, a hydrophobic stain repellency agent, a hydrophobic cross-linking agent, and optionally, other additives to impart various desirable attributes to the substrate. In this publication, new chemical compositions are contemplated wherein the relative amount and chain length of each of the aforementioned chemical agents may be optimized to achieve the desired level of performance for different target substrates within a single chemical composition.

Hydrophilic stain release agents may include ethoxylated polyesters, sulfonated polyesters, ethoxylated nylons, carboxylated acrylics, cellulose ethers or esters, hydrolyzed polymaleic anhydride polymers, polyvinylalcohol polymers, polyacrylamide polymers, hydrophilic fluorinated stain release polymers, ethoxylated silicone polymers, polyoxyethylene polymers, polyoxyethylene-polyoxypropylene copolymers, and the like, or combinations thereof. Hydrophilic fluorinated stain release polymers may be preferred stain release agents. Potentially preferred, non-limiting, compounds of this type include UNIDYNE® TG-992 and UNIDYNE® S-2003, both available from Daikin Corporation; REPEARL® SR1100, available from Mitsubishi Corporation; ZONYL® 7910, available from DuPont; and NUVA® 4118 (liquid) from Clariant. Treatment of a substrate with a hydrophilic stain release agent generally results in a surface that exhibits a high surface energy.

Hydrophobic stain repellency agents include waxes, silicones, certain hydrophobic resins, fluoropolymers, and the like, or combinations thereof. Fluoropolymers may be preferred stain repellency agents. Potentially preferred, non-limiting, compounds of this type include REPEARL® F8025 and REPEARL® F-89, both available from Mitsubishi Corp.; ZONYL® 7713, available from DuPont; E061, available from Asahi Glass; NUVA® N2114 (liquid), available from Clariant; and UNIDYNE® S-2000, UNIDYNE® S-2001, UNIDYNE® S-2002, all of which are available from Daikin Corporation. Treatment of a substrate with a hydrophobic stain repellency agent generally results in a surface that exhibits a low surface energy.

Hydrophobic cross-linking agents include those cross-linking agents which are insoluble in water. More specifically, hydrophobic cross-linking agents may include monomers containing blocked isocyanates (such as blocked diisocyanates), polymers containing blocked isocyanates (such as blocked diisocyanates), epoxy containing compounds, and the like, or combinations thereof. Diisocyanate containing monomers or diisocyanate containing polymers may be the preferred cross-linking agents. However, monomers or polymers containing two or more blocked isocyanate compounds may be the most preferred cross-linking agents. One potentially preferred cross-linking agent is REPEARL® MF, also available from Mitsubishi Corp. Others include ARKOPHOB® DAN, available from Clariant, EPI-REZ® 5003 W55, available from Shell, and HYDROPHOBOL® XAN, available from DuPont.

The total amount of the chemical composition applied to a substrate, as well as the proportions of each of the chemical agents comprising the chemical composition, may vary over a wide range. The total amount of chemical composition applied to a substrate will depend generally on the composition of the substrate, the level of durability required for a given end-use application, and the cost of the chemical composition. As a general guideline, the total amount of chemical solids applied to the substrate will be found in the range of about 10% to about 40% on weight of the substrate. More preferably, the total amount of chemical solids applied to the substrate may be found in the range of about 20% to about 35% on weight of the substrate. Typical solids proportions and concentration ratios of stain repellency agent to stain release agent to cross-linking agent may be found in the range of about 10:1:0 and about 1:10:5, including all proportions and ratios that may be found within this range. Preferably, solids proportions and concentration ratios of stain repellency agent to stain release agent to cross-linking agent may be found in the range of about 5:1:0 and about 1:5:2. Most preferably, solids proportions and concentration ratios of stain repellency agent to stain release agent to cross-linking agent may be 1:2:1.

The proportion of stain release agent to stain repellency agent to cross-linking agent may likewise be varied based on the relative importance of each property being modified. For example, higher levels of repellency may be required for a given end-use application. As a result, the amount of repellency agent, relative to the amount of stain release agent, may be increased. Alternatively, higher levels of stain release may be deemed more important than high levels of stain repellency. In this instance, the amount of stain release agent may be increased, relative to the amount of stain repellency agent.

Optionally, in addition to, or in place of, the stain release and/or stain repellency agents described above, halogenated lattices may be added to the flame retardant bath to further enhance the durability of the flame resistant finish. The term "halogenated lattices" refers to homopolymers and copolymers of polyvinyl chloride, polyvinylidene chloride, brominated polystyrene, chlorinated olefins, polychloroprenes, and the like. In some instances, it may be desirable to separately apply the stain release agent and the soil repellent agent.

Next, treated fabric with the urea based process is dried at low temperatures. In this instance, the term "low temperature" encompasses temperatures generally less than about 150° C. (302° F.) and, most preferably, from about 100° C. (212° F.) to about 150° C. (302° F.). This low temperature drying may occur in any conventional type of drying apparatus for a time sufficient to remove from about 85% to about 100% of the moisture content of the fabric. Although this step is preferred for most applications, particularly for ensuring uniform treatment across the fabric and consistency of flame resistant properties, it may be shortened or replaced by the application of high temperature heat in a single step (Step 30).

Next, treated fabric with the urea based process is cured at high temperatures. In this case, the term "high temperature" encompasses temperatures ranging from about 150° C. (302° F.) to about 190° C. (374° F.) and, more preferably, from about 160° C. (320° F.) to about 180° C. (356° F.), such temperatures being used for a period of time ranging from about 20 seconds to about 180 seconds. The curing temperature promotes a chemical reaction between the THP flame retardant compound and the hydroxyl groups on the cellulosic fibers (e.g., cotton fibers), thereby increasing the wash-durability of the flame retardant treatment. It has been found that temperatures lower than about 150° C. (302° F.) are generally insufficient to cure the flame retardant chemistry and that temperatures higher than about 190° C. (374° F.) tend to promote an excessive reaction between the flame resistant chemistry and the cellulosic fibers that degrades and weakens the fabric. Separate drying and curing steps are preferred, as they provide improved flame resistant properties in the treated fabric, as well as greater process control during manufacturing.

To complete the reaction of the flame retardant chemical within the fabric, the treated fabric should be oxidized to convert the trivalent phosphorous into the innocuous and more stable pentavalent form. The oxidation step also helps to remove any residual odor from the cured fabric and to produce maximum durability of the flame resistant fabric for extended washings. Oxidation may occur in a continuous process (such as by impregnating the cured fabric with a peroxide solution on a continuous range) or in a batch process (such as by submerging the cured fabric in a peroxide solution in a bath, vat, jig, or jet vessel).

In a continuous process, the fabric is conveyed through an aqueous solution of an oxidizing agent (for example, hydrogen peroxide) and, optionally, a wetting agent and/or surfactant, which causes substantial conversion of the phosphine compound mentioned above to a stable and durable pentavalent phosphate compound polymerized within the fabric. The cured fabric (using either the urea based or ammonia based process) is immersed in this peroxide bath to oxidize the phosphorous compound and to remove odors that may have been generated during the curing process. The peroxide bath contains a solution having from about 3% to about 50% of a peroxide, such as hydrogen peroxide. The preferred period for submersion ranges from about 10 seconds to about 90 seconds. The peroxide bath may optionally be heated to temperatures from about 30° C. (86° F.) to about 50° C. (122° F.).

Next, the fabric is submersed in a neutralizing solution made of an appropriate concentration of caustic. Preferably, although not absolutely required, the fabric is immersed in a caustic bath containing from about 2% to about 10% caustic for a period of about 60 seconds. After being immersed in the caustic bath, the fabric is then rinsed in water to remove any residual alkali from the neutralized fabric. Preferably, the water is heated to temperatures from about 49° C. (120° F.) to about 60° C. (140° F.).

Optionally, the fabric is then conveyed through a bath containing from about 0.5% to about 20% and, preferably, from about 0.5% to about 5%, of a reducing agent to reduce the releasable amount of formaldehyde on the fabric. Preferably, the formaldehyde levels are reduced to 300 parts per million or less; more preferably, to 200 parts per million or less. Suitable reducing agents include organic or inorganic compounds that react with formaldehyde at the temperatures mentioned above (that is, from about 20° C. to about 80° C.), examples of which include, but are not limited to, sulfite salts, bisulfite salts (including sodium bisulfite and ammonium bisulfite), thiosulfate salts, urea compounds (including urea, thiourea, ethylene urea, and hydroxyethylene urea), guanazole, melamine, dicyanoamide, biuril, carbodihydrazide, diethylene glycol, phenols, thiophenols, hindered amines, and the like.

It has been found that conveying the fabric through a pad/nip roll set-up is quite effective for this purpose. Preferably, the temperature of the reducing agent bath is from about 20° C. (68° F.) to about 80° C. (176° F.), and the exposure time of the fabric to the bath is about 20 to about 60 seconds, and the nip roll pressure is from about 15 psi to about 60 psi. This may be accomplished in one of two ways: either by immersing the fabric, rinsing the fabric (to remove reducing agent), and passing the fabric through a nip roll or by immersing the fabric and then passing the fabric through a nip roll and alternately through a vacuum or both. This latter approach—in which the rinsing step is omitted—is preferred, as the presence of a small amount of reducing agent on the fabric tends to result in less releasable formaldehyde on the fabric, as compared with the level obtained when the fabric is rinsed.

Next, the fabric is then dried at a relatively low temperature (that is, less than the curing temperature) to remove moisture from the fabric. Optionally, the treated fabric may be air dried.

Fabrics treated with the flame retardant reaction product from tetrakis (hydroxymethyl) phosphonium salt or it precondensate tend to have releasable formaldehyde under certain conditions. Releasable formaldehyde content may be measured using AATCC Test Method 112—Determination of Formaldehyde Release from Fabrics. Although a very large number of possible formaldehyde scavengers are reported in the literature, many of the known formaldehyde scavengers are not effective in reducing releasable formaldehyde on the flame retardant fabric described herein. However, hydrazides are found to have an unexpected dramatic effect in reducing the releasable formaldehyde level to less than about 100 ppm. Any aliphatic and aramatic hydrazides are conceived. Examples of hydrazides include carbohydrazide, semicarbohydrazide, adipic hydrazide, oxalic hydrazide, maleic hydrazide, halo-substituted benzoic hydrazide, benzhydrazide, hydroxybenoic hydrazide, dihydroxybenzoic hydrazide, aminobenzoic hydrazide, alkyl substituted benzoic hydrazide, acethydrazide, caprylic hydrazide, decanoic hydrazide, hexanoic hydrazide, malonic hydrazide, formic hydrazide, oxamic acid hydrazide, toluenesulfonyl hydrazide, propionic acid hydrazide, salicyloyl hydrazide, and thiosemicarbohydrazide.

A hydrazide is typically used at a sufficient amount on a fabric to reduce the releasable formaldehyde content to 300 ppm, 200 ppm or 100 ppm or less. Preferably, the releasable formaldehyde level is less than 200 ppm, more preferably less than 100 ppm, more preferably less than 75 ppm. A solution containing a hydrazide is used to impregnate, coat or otherwise apply to a fabric treated with FR product derived from tetrakis (hydroxymethyl) phosphonium salt or its pre-condensate. Hydrazide amount on the fabric may range from 0.2% to about 6%, 0.5% to about 3%, or 1-2% all by weight. After the hydrazide is applied to a flame resistant treated fabric, the fabric is then dried to remove any volatile solvent. High temperatures were found to affect the effectiveness of the hydrazide treatment. The drying temperature is typically controlled such that the fabric temperature doesn't reach above 300° F. for more than 10 second or so. Fabric temperature during drying step is preferably controlled between 160° F. and 290° F., or 180° F. and 250° F.

The fabric pH may be further adjusted to between 4 and 8, or 5 and 7. pH above 8 after hydrazide treatment tends to cause discoloration of fabric. pH below 4 may not result in most effective reduction of releasable formaldehyde. The fabric may be washed, rinsed in an alkaline containing water solution before the hydrazide treatment to make sure the fabric pH fall into the desired range. Alternative, a buffer compound may be further added to the hydrazide treatment solution to adjust the fabric pH to the range mentioned above. Any buffer compound known to an ordinary skill in the art may be used. Examples of buffer solution include hydroxy amines, amines, hydrophosphate salt, alkaline metal salt of acetate, citrate, silicate, or the like. Examples of hydroxyamines include triethanolamine, diethanol/methylamine, diethylethanolamine, aminomethylpropanol, aminomethylpropanol, tris (hydroxymethyl)aminomethane, aminopropanediol, aminobutanol, aminomethylpropanediol, oxazolidine and its derivatives. Hindered amines and tertinary amines may also be used as a buffer material along with the hydrazide.

There is an optional application of a soil repellent agent to one side of the fabric. Optionally, a stain release agent may be included with the soil repellent agent. The soil repellent agents and stain release agents are those provided above. The preferred method of application is by foaming, such that the soil repellent agent (and, optionally, the stain release agent) is localized on one side of the treated fabric, preferably the outwardly-facing side of the fabric which is not in contact with the skin of the wearer. Foaming may be achieved by including a foaming agent in the soil repel/stain release agent solution and agitating air into the mixture. Suitable foaming agents include amine oxides, amphoteric surfactants, and ammonium stearates.

Such application, especially of the soil repellent agent, has been found particularly advantageous in extending the useful life of garments made from the treated fabric. It has been well-documented that the useful life of flame resistant garments is often shortened because the garments are soiled by greasy stains, such as oil. Not only are these types of stains difficult to remove with ordinary laundering, but the stains themselves tend to be flammable. Thus, it is advantageous to provide a soil repellent agent to at least the outward-facing side of the treated fabric to prevent such stains from becoming absorbed by the treated fabric. Moreover, it has been found that by applying the soil repellent agent(s) to the outward-facing side of the fabric, the wicking properties of the fabric are maintained, thereby preserving the comfort level for the wearer of the garment.

If there is an application of a soil release agent, then there is the drying and, possibly, curing of the soil repellent agent and/or stain release agent. The temperatures used for such drying and/or curing are typically in the range of about 150° C. (302° F.) to about 190° C. (374° F.), depending on the particular soil repellent agent and, optionally, stain release agent that are used.

It is worth noting that fabrics treated with the ammoniation process (that is, those fabrics that have been treated with a flame retardant chemical and then exposed to gaseous ammonia) in certain instances may not subsequently be treated with soil repellent agents, as described above, because these soil repellent chemistries typically require high temperature conditions for drying and/or curing. Under these conditions, the ammonia-treated fabric generates offensive odors. Thus, the present process provides a viable means for imparting treated fabrics with soil repellent chemistries, which are unavailable to users of the ammoniation process.

To further enhance the fabric's hand, the fabric may optionally, and preferably, be treated with a mechanical surface treatment. The mechanical surface treatment, as described below, relaxes stress imparted to the fabric during curing and fabric handling, breaks up yarn bundles stiffened during curing, and increases the tear strength of the treated fabric. Because, in most instances, a softener alone is insufficient to impart the desired degree of softness and flexibility in the treated fabric, the use of mechanical surface treatment is recommended.

Representative examples of such mechanical surface treatments include treatment with high-pressure streams of air or water, as described in U.S. Pat. No. 4,837,902 to Dischler; U.S. Pat. No. 4,918,795 to Dischler; U.S. Pat. No. 5,033,143 to Love, III; U.S. Pat. No. 5,822,835 to Dischler; and U.S. Pat. No. 6,546,605 to Emery et al.; intermittent impact against sanding rolls, as described in U.S. Pat. No. 4,631,788 to Otto (all of which are incorporated herein by reference); treatment with steam jets; needling; particle bombardment; ice-blasting; tumbling; stone-washing; constricting through a jet orifice; and treatment with mechanical vibration, sharp bending, shear, or compression. A sanforizing process may be used in addition to one or more of the above processes to improve the fabric's hand and to control the fabric's shrinkage.

Additional mechanical treatments that may be used to impart softness to the treated fabric, and which may also be followed by a sanforizing process, include napping; napping with diamond-coated napping wire; gritless sanding; patterned sanding against an embossed surface; shot-peening; sand-blasting; brushing; impregnated brush rolls; ultrasonic agitation; sueding; engraved or patterned roll abrasion; impacting against or with another material, such as the same or a different fabric, abrasive substrates, steel wool, diamond grit rolls, tungsten carbide rolls, etched or scarred rolls, or sandpaper rolls; and the like.

An effective mechanical treatment provides a softening effect by breaking up the flame resistant finish, separating the fibers (within the yarn bundle) from one another, and/or flexing the individual yarns, thereby increasing the flexibility and tear strength of the treated fabric. Flexing by high velocity fluid jet and mechanical impingement, for example, produces effective softening of the hand of the treated fabric and improvement in tear strength of the treated fabric.

Importantly, the resulting flame resistant fabrics successfully meet the flammability requirements for many end-uses. Furthermore, these fabrics tend to exhibit the characteristics of fabrics treated with permanent press resins—that is, the tendency to resist wrinkling, to retain its shape, and to retain a crease or pleat through laundering—without the use of additional permanent press resins. These fabrics typically do not require ironing if they are tumble dried, making them advantageous for use as uniform fabrics.

It is believed that the process causes a chemical coupling reaction of the reactive THP or THP condensate with the hydroxyl groups of the cellulosic fibers at elevated curing temperatures, resulting in covalent bonding of the phosphorous flame retardant to the cotton fibers. The reactive THP also cross-links the cellulosic fibers (e.g., cotton fibers) to one another, in such a manner that the flat-dry appearance of the laundered fabric is improved (that is, when laundered, the treated fabric lies flatter than the untreated fabric).

As mentioned above, stain release agents and/or stain repellency agents may be incorporated, either separately or in combination, into the flame retardant bath to provide the additional properties of stain release and/or stain repellency. These properties may be achieved without the need for subsequent process steps, which increase production time and cost. Moreover, the use of the preferred stain release and stain repel agents described previously has no detrimental effect on the ability of the treated fabric to meet flammability requirements. In some circumstances, the incorporation of these compounds into the flame resistant bath results in improved durability of the flame retardant treatment.

The following non-limiting examples are representative of flame resistant fabrics manufactured according to the present processes.

EXAMPLES

Test Methods

Evaluation: Flammability

The fabric Examples were evaluated for flammability performance, using an instrumented manikin (commonly referred to as "PYROMAN®") device according to Test Method ASTM F1930 entitled "Standard Test Method for Evaluation of Flame Resistant Clothing for Protection Against Flash Fire Simulations Using an Instrumented Manikin," using a three-second exposure time. This test method provides a measurement of garment and clothing ensemble performance on a stationary upright mannequin when exposed to a flash fire at a calibrated 2.0 calorie/cm$^2$ s heat flux as determined by a set of sensors embedded in the manikin skin. A percentage body burn of less than 50% is considered passing according to the industry standard, NFPA 2112-2007.

Evaluation: Arc Testing

The fabric Examples were also evaluated for arc protection, according to Test Method ASTM F1959 entitled "Standard Test Method for Determining the Arc Rating of Materials for Clothing." This test method is intended for the determination of the arc rating of a material, or a combination of materials. The numbers reported below are the Arc Thermal Performance Values (ATPV) for each Example, where higher numbers indicate better protection from thermal burns. An arc rating of at least 4 cal/cm$^2$ but less than 8 cal/cm$^2$ is appropriate for Hazard/Risk Category (HRC) 1, an arc rating of at least 8 cal/cm$^2$ but less than 25 cal/cm$^2$ meets HRC 2, an arc rating of at least 25 cal/cm$^2$ but less than 40 cal/cm$^2$ meets HRC 3 and an arc rating of at least 40 cal/cm$^2$ meets HRC 4.

Examples 1-3

Example 1

The fabric used in Example 1 was a chambray fabric in a 2×1 twill weave having a weight of 5.69 oz/yd$^2$. The warp yarns and filling yarns were an 88/12 by weight blend of cotton and nylon.

The fabric was woven from blue dyed warp yarns and undyed filling yarns. It was then prepared on a standard open width continuous preparation range following the steps of desizing, washing and drying. The fabric was taken-up for further processing.

An FR treatment was applied to the fabric in the following manner. The fabric was passed through a pad bath of a tetrakis (hydroxymethyl) phosphonium (THP) precondensate sulfate salt, urea, and cationic softener before entering a curing oven. The THP salt concentration was about 55% by weight of the formulation solution.

The THP salt was reacted on the fabric with urea to create an intermediate compound in which the phosphorous compound is present in its trivalent form. Such reaction was carried out in the fabric at a temperature of about 330° F. for about 1 minute to cause the THP (salt or condensate) to form covalent bonds with the cellulosic fibers, thus imparting greater durability of the flame retardant treatment to washing. The treated fabric was then conveyed through a peroxide bath, in which the peroxide oxidizes the phosphorous compound to fix the flame retardant compound to the fabric surface and to convert the trivalent phosphorous to its stable pentavalent form.

Following the FR treatment the fabric was again dried and taken-up for further processing. The fabric was taken to a tenter range for finishing and passed through a pad which contained a formaldehyde scavenger, and a high-density polyethylene used as a lubricant. The fabric was overfed onto the tenter pins at about 3% overfeed and dried in ovens set at about 160° C. (320° F.) for about 70 seconds.

After chemical finishing, the fabric was subjected to mechanical treatment via a plurality of high pressure (40-90 psig) air jets, which induced vibration in the fabric and which resulted in a softening of the fabric hand and an improvement in tear strength. This mechanical treatment is described in detail in U.S. Pat. No. 4,837,902; U.S. Pat. No. 4,918,795; and U.S. Pat. No. 5,822,835, all to Dischler. Following the mechanical treatment, the fabric was processed through a sanforizor to compact and pre-shrink.

Example 2

The fabric used in Example 2 was a commercially available flame resistant chambray fabric in a 2×1 twill weave from Westex. The fabric was obtained as a swatch in a marketing brochure from a trade show in 2008. The warp yarns were a 75/25 by weight blend of cotton and nylon dyed blue and the filling yarns were 100% cotton (white) for an overall 88/12 by weight blend of cotton and nylon. It is believed that the Westex product used the ammonia based FR treatment described in the specification and a mechanical treatment.

Example 3

The fabric used in Example 3 was a commercially available flame resistant solid fabric in a 2×1 twill weave from Bulwark as the Bulwark Excel FR 6.0 oz 2×1 twill khaki shirt. The shirt was purchased from VF Imagewear, Bulwark's parent company in September 2009. The product ID listed was SLU6 KH, waist RG, length XL. The warp yarns were a 75/25 by weight blend of cotton and nylon, the filling yarns were 100% cotton for an overall 88/12 by weight blend of cotton and nylon and the fabric was a dyed a khaki shade. It is believed that the Bulwark product used the ammonia based FR treatment described in the specification and it is unclear whether or not a mechanical treatment was applied to the fabric.

TABLE 1

| Physical and performance characteristics of Examples 1-3 | | | |
|---|---|---|---|
| | Example 1 | Example 2 | Example 3 |
| Weave Type | 2 × 1 Twill | 2 × 1 Twill | 2 × 1 Twill |
| Warp Yarn (Cotton/Nylon) | 88/12 | 75/25 | 75/25 |
| Filling Yarn | 88/12 cot/nyl | 100% cotton | 100% cotton |
| Overall Blend (Cotton/Nylon) | 88/12 | 88/12 | 88/12 |
| FR Chemistry | Urea-type | Believed to be ammonia type | Believed to be ammonia type |
| Color | Blue | Blue | Khaki |
| Physical Attributes | | | |
| Weight (oz/yd$^2$) | 5.69 | 6.3 | 6.41 |
| Thickness - as received (mils) | 16.4 | 17.35 | 16.4 |
| Weight after 3 120F home launderings (oz/yd$^2$) | 5.6 | 6.02 | 6.58 |
| Thickness after 3 120F home launderings (mils) | 20.7 | 21.0 | 20.4 |
| FR Performance | | | |
| ARC RATING - ATPV (cal/cm2) | 6.5 | 5.2 | 5.8 |
| PYROMAN - % Body Burn | | | |
| Comfort Attributes | | | |
| Average Air Permeability As received (cfm) | 98 | | 48.9 |
| Average Air Permeability after 3 120F home launderings (cfm) | 82.37 | | 32.5 |

Examples 1-3 were twill weaves having weights less than 7 oz/yd$^2$. Each of the fabrics had thicknesses as received less than 19.5 mils and thicknesses after 3 home launderings of less than 25 mils. As can be seen from Table 1, each of Examples 1-3 failed to meet the HRC2 arc rating requirement (greater or equal to 8 cal/cm$^2$ is passing).

Examples 4-6

Example 4

The fabric used in Example 4 was a 4×1 sateen weave fabric having a weight as received of 6.9 oz/yd$^2$. The warp yarns and filling yarns were an 88/12 by weight blend of cotton and nylon. The fabric was treated the same as Example 1 with the exception that the fabric was dyed light blue and had no mechanical finishing process.

Example 5

The fabric used in Example 5 was a 4×1 sateen weave fabric having a weight as received of 6.48 oz/yd$^2$. The warp yarns and filling yarns were an 88/12 by weight blend of cotton and nylon. The fabric was treated the same as Example 1 (including FR treatment, formaldehyde treatment, lubricant, mechanical finishing, and sanforizor treatment), except that the fabric was dyed navy.

Example 6

The fabric used in Example 6 was a 4×1 sateen weave fabric having a weight as received of 6.29 oz/yd$^2$. The warp yarns and filling yarns were an 88/12 by weight blend of cotton and nylon. The fabric was treated the same as Example 1, except that instead of the urea-based FR treatment used in Example 1, an ammonia based treatment (as described in the specification) was used.

TABLE 2

| Physical and performance characteristics of Examples 4-6 | | | |
|---|---|---|---|
| | Example 4 | Example 5 | Example 6 |
| Weave Type | 4 × 1 Sateen | 4 × 1 Sateen | 4 × 1 Sateen |
| Warp Yarn Type (Cotton/Nylon) | 88/12 | 88/12 | 88/12 |
| Filling Yarn (Cotton/Nylon) | 88/12 | 88/12 | 88/12 |
| Overall Blend (Cotton/Nylon) | 88/12 | 88/12 | 88/12 |
| FR Chemistry | Urea-type | Urea-type | Ammonia type |
| Color | Light blue | Navy | Khaki |
| Physical Attributes | | | |
| Weight (oz/yd$^2$) | 6.9 | 6.48 | 6.29 |
| Thickness - as received (mils) | 19 | 20 | 20.8 |
| Weight after 3 120F home launderings (oz/yd$^2$) | 6.84 | 6.51 | 6.8 |
| Thickness after 3 120F home launderings (mils) | 24.5 | 27.2 | 29.8 |
| FR Performance | | | |
| ARC RATING - ATPV (cal/cm2) | 7.1 | 8.9 | 8.8 |
| PYROMAN - % Body Burn | 26.2 | 39.0 | — |
| Comfort Attributes | | | |
| Average Air Permeability As received (cfm) | 124 | 147.3 | 130.3 |
| Average Air Permeability after 3 120F home launderings (cfm) | 103 | 120 | — |

As can be seen from Table 2, Example 4, did not have the mechanical treatment, did not have a thickness of greater than 19.5 mils as received or a thickness of greater than about 25 mils after 3 launderings. Example 4 failed to meet the HRC2 arc testing requirement. Examples 5 and 6 met all of the limitations, namely they had weights less than 7 oz/yd$^2$, had thicknesses as received greater than 19.5, had thicknesses after 3 launderings greater than 25 mils, and had air permeability greater than about 60 cfm. These Examples 5 and 6 passed the HRC2 arc testing and pyroman testing requirements.

Examples 7-10

Example 7

The fabric used in Example 7 was a 3×1 twill weave fabric having a weight as received of 7.69 oz/yd$^2$. The warp yarns and filling yarns were an 88/12 by weight blend of cotton and nylon. The fabric was treated the same as Example 1 (including FR treatment, formaldehyde treatment, lubricant, mechanical finishing, and sanforizor treatment), except that that fabric was dyed a navy color.

Example 8

The fabric used in Example 8 was a 3×1 twill weave fabric having a weight as received of 7.45 oz/yd$^2$. The warp yarns were an 75/25 by weight blend of cotton and nylon and the filling yarns were 100% cotton. The fabric was treated the same as Example 1 (including FR treatment, formaldehyde treatment, lubricant, mechanical finishing, and sanforizor treatment), except that that fabric was dyed a navy color.

Example 9

The fabric used in Example 9 was a commercially available 7 oz 3×1 twill Excel FR coverall purchased online from Bulwark in 2008 product ID CLBNV2. The arc rating listed also comes from the garment label which lists the arc rating as 8.6 ATPV. The warp yarns were an 75/25 by weight blend of cotton and nylon and the filling yarns were 100% cotton. The fabric was a dyed a khaki shade. It is believed that the Bulwark product used the ammonia based FR treatment described in the specification and it is unclear whether or not a mechanical treatment was applied to the fabric.

Example 10

The fabric used in Example 10 was a commercially available flame resistant fabric in a 3×1 twill weave from Westex as the 7 oz Westex Indura Ultrasoft Style 301 Shirting. The fabric was listed as 7 oz with a listed arc rating of 8.7 ATPV. The warp yarns were an 75/25 by weight blend of cotton and nylon and the filling yarns were 100% cotton. The fabric was a dyed a navy shade. It is believed that the Westex product used the ammonia based FR treatment described in the specification and a mechanical treatment.

TABLE 3

Physical and performance characteristics of Examples 7-10

| | Example 7 | Example 8 | Example 9 | Example 10 |
|---|---|---|---|---|
| Weave Type | 3 × 1 Twill | 3 × 1 Twill | 3 × 1 Twill | 3 × 1 Twill |
| Warp Yarn (Cotton/Nylon) | 88/12 | 75/25 | 75/25 | 75/25 |
| Filling Yarn | 88/12 C/N | 100% cotton | 100% cotton | 100% cotton |
| Overall Blend (Cotton/Nylon) | 88/12 | 88/12 | 88/12 | 88/12 |
| FR Chemistry | Urea-type | Urea-type | Ammonia type (believed) | Ammonia type (believed) |
| Color | Navy | Navy | Khaki | Navy |
| Physical Attributes | | | | |
| Weight (oz/yd$^2$) | 7.69 | 7.45 | 7.96 | 7.6 |
| Thickness - as received (mils) | 0 | 18.8 | 20.6 | 20.7 |
| Weight after 3 120F home launderings (oz/yd$^2$) | 7.7 | 7.82 | 8.3 | 7.7 |
| Thickness after 3 120F home launderings (mils) | 26.05 | 26.35 | 23.0 | 24.5 |
| FR Performance | | | | |
| ARC RATING - ATPV (cal/cm2) | 9.2 | 9.2 | 8.6* | 8.7* |
| PYROMAN - % Body Burn | 18.3 | 19.12 | 0 | 28 |
| Comfort Attributes | | | | |
| Average Air Permeability As received (cfm) | 68.3 | 88.9 | 32 | 33 |
| Average Air Permeability after 3 120F home launderings (cfm) | 48.5 | — | 30.0 | 36.0 |

*provided by manufacturer, not tested

As can been seen from Table 3—each of the Examples 7-10 do meet the FR tests, however, all of the Examples 7-10 have weights that are greater than 7 oz/yd$^2$. These higher weight fabrics are not preferred as they tend to be heavier and have lower air permeability leading to a less comfortable wear.

As can been from Examples 1-10, only Examples 5 and 6 had low weight, high thickness, high air permeability, and passed both the pyroman and arc testing to produce flame and arc resistant light weight sateen weave protective clothing.

Formaldehyde Scavenging

A woven fabric made of 88% cotton fiber and 12% Nylon 6,6 fiber was dyed and finished with a flame retardant containing tetrakis (hydroxymethylphosphonium)-urea condensate and was impregnated with various different post-treatment solutions. The releasable formaldehyde was measured using AATCC Test Method 112—"Determination of Formaldehyde Release from Fabrics: Sealed Jar Method". The results are reported in ppm of detected formaldehyde based on the weight of the tested fabric.

TABLE 4

Releasable formaldehyde when FR treated fabric is treated with various formaldehyde scavengers

| Treatment solution | % add-on by weight of fabric | Releasable Formaldehyde, ppm |
|---|---|---|
| Water (control) | 0 | 563 |
| carbohydrazide | 0.4 | 370 |
| carbohydrazide | 0.8 | 210 |
| carbohydrazide | 1.2 | 117 |
| carbohydrazide | 1.6 | 25 |
| carbohydrazide | 3.2 | 30 |
| adipic hydrazide | 1.6 | 248 |
| oxalic hydrazide | 1.6 | 124 |

As one can see from Table 4, carbohydrazide at levels of at least 1.6% add on by weight of fabric produced releasable formaldehyde levels of less than 75 ppm. Adipic hydrazide and oxalic hydrazide do reduce the levels of releasable formaldehyde as compared to the control and may reduce the levels further at higher add on levels.

Example 11

This example demonstrates the effects on releasable formaldehyde obtained by treating a flame resistant textile as described herein with a hydrazide compound.

A fabric having a weight of approximately 7 oz/yd$^2$ made by weaving warp and fill yarns comprising a blend of approximately 88 wt. % cotton and 12 wt. % nylon staple fibers was treated as described above. In particular, the fabric was treated with an aqueous mixture of a tetrakis (hydroxymethylphosphonium)-urea condensate and urea, and the applied treatment mixture was then dried and cured to produce a trivalent phosphate compound on the fabric. The fabric was then treated in a peroxide bath to convert the trivalent phosphorous compound to its pentavalent form.

The resulting flame resistant textile was then padded with an aqueous solution containing 4 wt. % semicarbazide-HCl at a nip pressure of approximately 40 psi. After padding, the textile was dried in a convection oven at a temperature of about 300° F. for approximately 3 minutes.

The releasable formaldehyde content of the resulting treated textile was then measured in accordance with AATCC Test Method 112—"Determination of Formaldehyde Release from Fabrics: Sealed Jar Method." The flame resistant textile treated with semicarbazide-HCl exhibited a releasable formaldehyde content of approximately 56 ppm, while a similar flame resistant textile that had not been treated with semicarbazide-HCl exhibited a releasable formaldehyde content of approximately 511 ppm.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

We claim:

1. A flame resistant textile comprising:

a sateen weave fabric having a plurality of warp yarns and a plurality of fill yarns, wherein the warp yarns and fill yarns have the same fiber content, the fiber content is selected from the group consisting of 100% cellulosic fibers and intimate blends of cellulosic fibers and thermoplastic synthetic fibers, wherein the sateen weave fabric consists of 75-100% by weight cellulosic fibers and 0-25% by weight thermoplastic synthetic fibers, wherein the thermoplastic synthetic fibers are selected from the group consisting of polyesters, polyolefins, polyamides, polyphenylenesulfide, and mixtures thereof, and wherein the sateen weave fabric has an as received thickness of at least 19.5 mils, a thickness of at least 25 mils after 3 home washes at 120° F., an air permeability of at least 60 cfm, and a weight of less than 7 oz/yd$^2$;

a treatment applied to the sateen weave fabric, wherein the treatment comprises a tetramethylhydroxy phosphonium salt or its condensate and a chemical selected from the group consisting of urea, $NH_3$, guanidines, guanyl urea, glycoluril, and polyamines;

such that, when the sateen weave fabric to which the treatment has been applied has been heat-cured and oxidized at least a portion of the cellulosic fibers have a pentavalent phosphate compound polymerized therein.

2. The flame resistant textile of claim 1, wherein the flame resistant textile meets the HRC 2 protection level requirements according to NFPA 70E/ASTM F 1506 and also meets the requirements of NFPA 2112 as tested in accordance with ASTM F 1930.

3. The flame resistant textile of claim 1, wherein the sateen weave fabric has a weight of less than 6.5 oz/yd$^2$.

4. The flame resistant textile of claim 1, wherein the treatment comprises tetrahydroxymethyl phosphonium salt or its condensate, urea, and a cationic softening agent.

5. The flame resistant textile of claim 1, wherein the pentavalent phosphate compound includes amide linking groups.

6. The flame resistant textile of claim 1, wherein the pentavalent phosphate compound includes amine linking groups.

7. The flame resistant textile of claim 1, further comprising a hydrazide compound at an amount not less than 0.5% by weight of the fabric.

8. The flame resistant textile of claim 7, wherein the hydrazide compound is a chemical selected from the group consisting of carbohydrazide, semicarbohydrazide, adipic hydrazide, oxalic hydrazide, maleic hydrazide, halo-substituted benoic hydrazide, benzhydrazide, hydroxybenoic hydrazide, dihydroxybenzoic hydrazide, aminobenzoic hydrazide, alkyl substituted benzoic hydrazide, acethydrazide, caprylic hydrazide, decanoic hydrazide, hexanoic hydrazide, malonic hydrazide, formic hydrazide, oxamic acid hydrazide, toluenesulfonyl hydrazide, propionic acid hydrazide, salicyloyl hydrazide, and thiosemicarbohydrazide.

9. The flame resistant textile of claim 7, wherein the hydrazide comprises carbohydrazide.

10. The flame resistant textile of claim 7, wherein the fabric has a releasable formaldehyde content of 100 ppm or less tested according to AATCC Test Method 112.

11. The flame resistant textile of claim 1, wherein the sateen weave fabric consists of 75-90% by weight cellulosic fibers and 10-25% by weight thermoplastic synthetic fibers.

12. The flame resistant textile of claim 11, wherein the sateen weave fabric consists of 80-90% by weight cellulosic fibers and 10-20% by weight thermoplastic synthetic fibers.

* * * * *